United States Patent [19]

Ecklund

[11] Patent Number: 4,679,237

[45] Date of Patent: Jul. 7, 1987

[54] CORRECTION CONTROL CIRCUIT FOR AM STEREOPHONIC RECEIVERS

[75] Inventor: Lawrence M. Ecklund, Wheaton, Ill.

[73] Assignee: Motorola, Inc., Schaumburg, Ill.

[21] Appl. No.: 761,730

[22] Filed: Aug. 2, 1985

[51] Int. Cl.[4] ..... H04H 5/00

[52] U.S. Cl. ..... 381/15; 455/216

[58] Field of Search ..... 381/15, 16; 329/112; 455/216

[56] References Cited

U.S. PATENT DOCUMENTS 4,371,747 2/1983 Hilbert ..... 381/15

4,377,728 3/1983 Hilbert ..... 381/15

*Primary Examiner*—Forester W. Isen

*Attorney, Agent, or Firm*—Margaret Marsh Parker; James W. Gillman

[57] ABSTRACT

A correction control circuit for use in compatible AM stereophonic receivers of the type utilizing a cosine correction signal to remove inherent distortion from the received and detected signals. During periods of weak or noisy signals or when co-channel interference is present, excess cosine correction signal causes a reduction in the amount of stereo difference signal component in the output signals, and in the amount of correction provided. In a worst case signal situation, there will be no difference signal component in the output and the monophonic output not be corrected.

15 Claims, 4 Drawing Figures

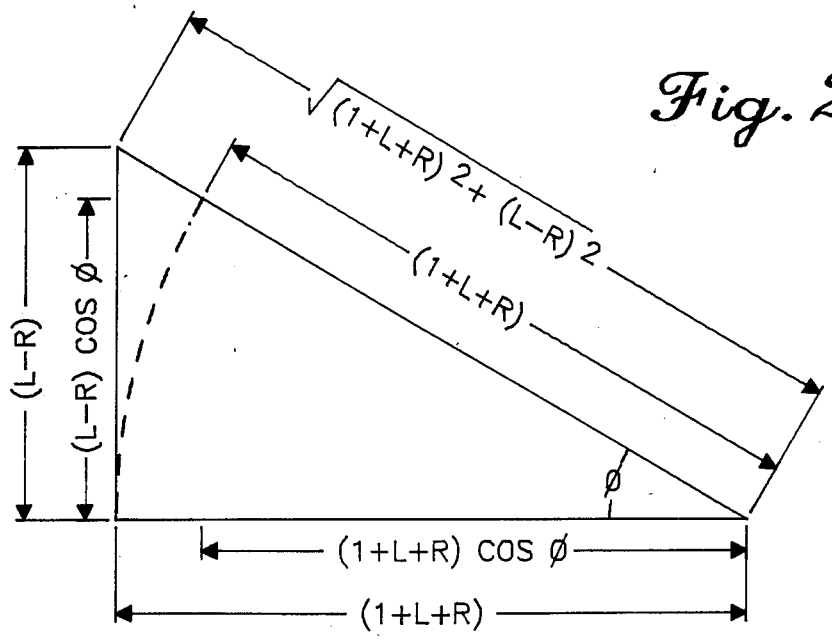
Fig. 2
Fig. 3
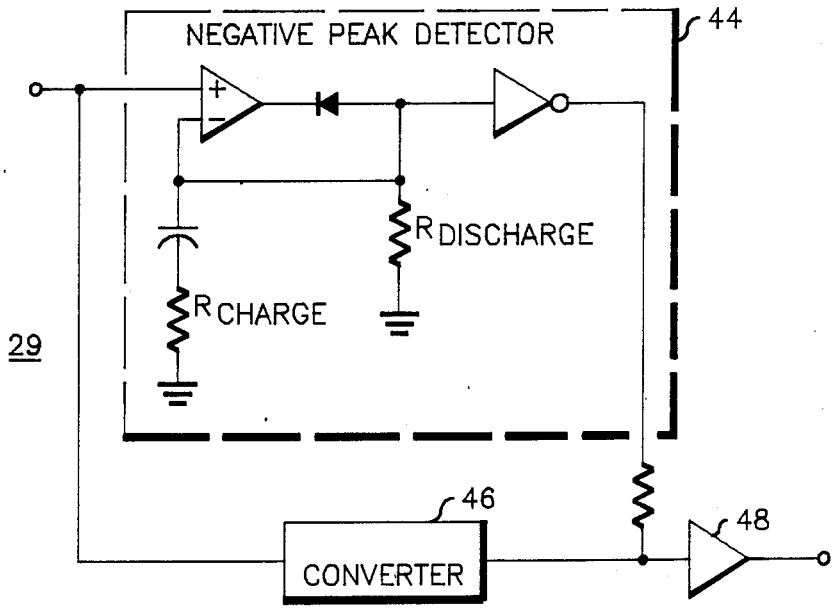

CORRECTION CONTROL CIRCUIT FOR AM STEREOPHONIC RECEIVERS

BACKGROUND OF THE INVENTION

This invention relates to the field of AM stereophonic reception and, more particularly, to means of controlling the cosine corrector circuit of a C-QUAM ® stereo radio receiver during reception of unsatisfactory signals.

In the field of AM stereophonic receivers, the requirement for compatibility means that the envelope of the received signal must be the same as the envelope of a monophonic system having the same intelligence signal inputs. In the C-QUAM system, the envelope is therefore 1+L+R, but the phase modulation is the same as the phase modulation of a pure quadrature (non-compatible) signal. In a typical receiver, the intelligence signals may be detected as L cos $\phi$ and R cos $\phi$ where $\phi$ is the angle whose tangent is [(L−R)/(1+L+R)]. In order to restore the original L (left) and R (right) signals, a "cosine correction signal" is used. This correction signal may be derived from the received signal in any of several ways, but if the receiver signal is very weak, very noisy, or contains an appreciable element of co-channel interference, the derived correction signal may be inaccurate and could even introduce more distortion than it removes or could increase the noise components in the signal.

In a U.S. Pat. No. 4,159,396, assigned to the assignee of the present invention, a relatively simple solution to this problem was disclosed. Briefly, a switching circuit was added to a receiver, with the capability of disenabling the cosine correction function. The switching circuit was controlled by the output signal of a comparator which compared the level of the AGC circuit output with a reference voltage (DC). When the AGC signal went below the reference voltage, an electronic switch was activated to open the path of the cosine correction signal. The result of this procedure was to remove the correction signal during weak signals, when its presence would do more harm than good. However, the AGC signal turned out to be a poorer source of signal information for this purpose than had been expected. Also, the abrupt transition may be perceptible and may introduce even more distortion, particularly if the AGC signal happens to hover around the reference level for even a brief interval.

SUMMARY

It is, therefore, an object of the present invention to provide a means of improving the quality of the audio outputs of an AM stereo receiver during conditions of poor received signals.

It is a more particular object to provide such capability with a minimum of perceptibility to the user.

These objects and others which will become apparent are obtained in a circuit according to the present invention wherein two detectors derive two signals from the received signal. These two signals, I cos $\phi$ and Q cos $\phi$ ("I" for in-phase, "Q" for quadrature) are "in quadrature" to each other. That is, these two baseband signals were transmitted in quadrature to each other on the same carrier frequency. Both signals are coupled to a circuit which outputs the square root of the sum of the squares of the individual input signals. The resultant signal, which is the true envelope signal, is compared with a "corrected" I signal and the difference or error is coupled back to corrector or divider circuits to correct each of the two detected signals. The correction signal also controls an amplifier circuit in the Q signal path. Thus, when the "correction" signal is out of the normal range, the amount of Q signal which is coupled to the squaring circuit is reduced accordingly. This makes the squaring circuit output approach I cos $\phi$ and reduces the value of correction. The ultimate result would be pure quadrature (QUAM) during extremely poor receiving conditions.

Alternatively, as the received signal becomes poorer, the amount of Q signal being coupled to the matrix can also be reduced, so that the audio outputs become monophonic as well as uncorrected. Thus, an extreme point could be reached whereat no Q signal would be coupled to the matrix and the monophonic output signal would be entirely uncorrected. This would be the optimum output signal for very poor reception conditions.

BRIEF DESCRIPTION OF THE DRAWING

FIG. 2 is a vector diagram of signals relating to FIG. 1.

FIG. 3 is a schematic diagram of an embodiment of one element of the diagram of FIG. 1.

DETAILED DESCRIPTION OF A PREFERRED EMBODIMENT

Figure 1:
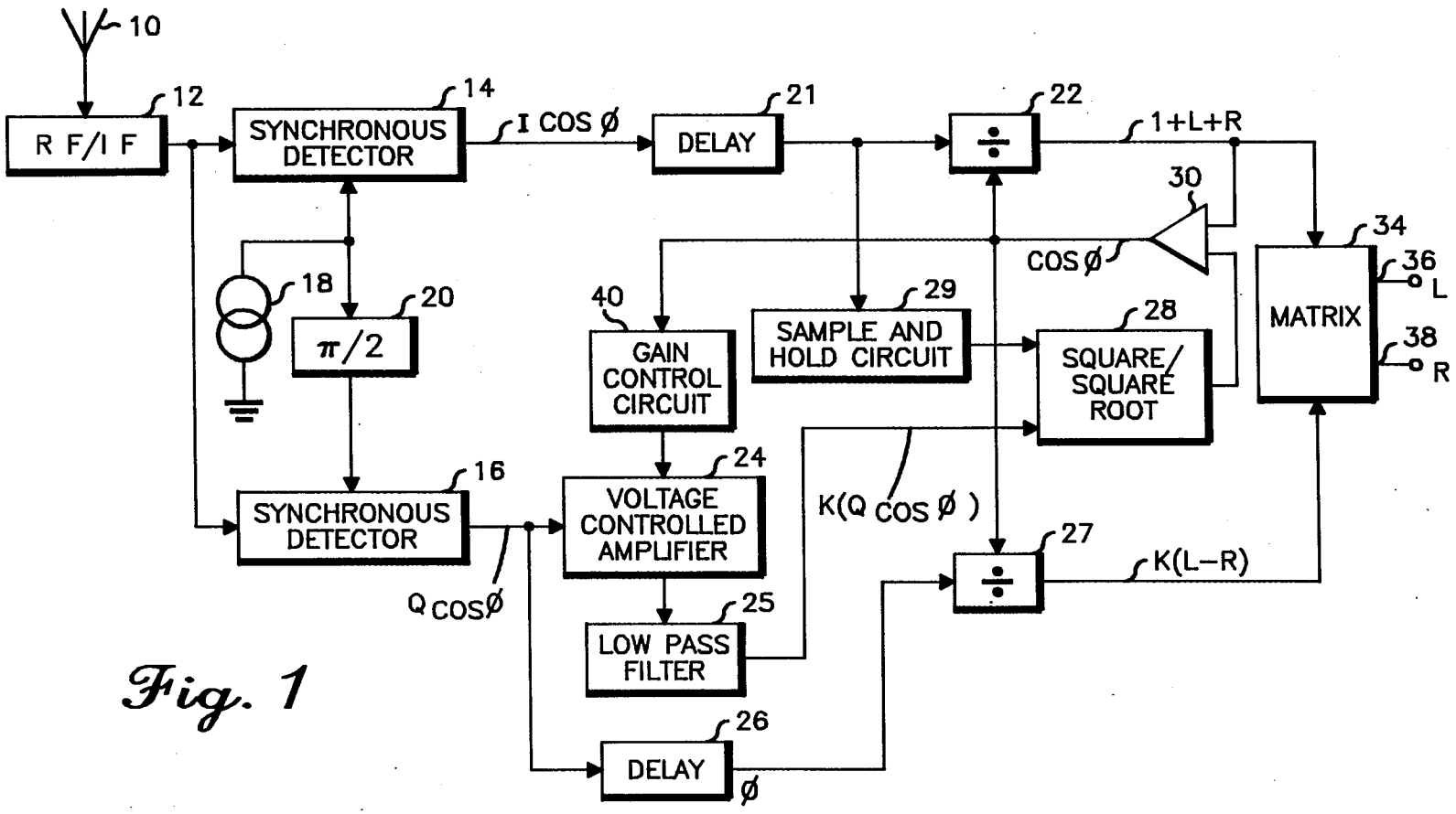
FIG. 1 is a block diagram of an AM stereophonic receiver including the correction control circuit of the present invention.

FIG. 1 is a simplified block diagram of an exemplary C-QUAM stereophonic receiver such as might include the present invention. This diagram is not to be considered as limiting the invention; the only limitations being those of the appended claims.

Received through an antenna 10 would be a broadcast signal of the C-QUAM type disclosed in a U.S. Pat. No. 4,218,586, assigned to the assignee of the present invention. This signal may be represented by the formula:

$$(1+L+R)\cos(w_c t+\phi)$$

where L and R are intelligence signals and $$\phi=\arctan[(L-R)/(1+L-R)].$$

A block 12 represents the RF/IF stages of the receiver, which may be of any suitable design. The output signal from the block 12 is an intermediate frequency signal which is coupled to two synchronous detectors 14,16. Also coupled to the detectors 14,16 is a source 18 of intermediate carrier frequency and a 90° phase shifter 20. Thus, the output signals of the two detectors will be I cos $\phi$ and Q cos $\phi$ under normal signal conditions. The output of the synchronous detector 14 is coupled through a delay line 21 to a divider 22 wherein it is normally divided by a signal corresponding to cosine $\phi$, resulting in a divider output signal of 1+L+R. The output of the synchronous detector 16 is coupled through a voltage-controlled amplifier 24 and a low pass filter 25 and, in parallel, through a delay line 26 to a second divider 27 wherein it, likewise, is normally divided by the signal corresponding to cosine $\phi$, with a resulting output of L−R. The purpose of the delay line 21 is to provide a delay for the I signal which is equal to the delay provided for the Q signal in the low pass filter 25. The output of the synchronous detector 14 and the output of the low pass filter 25 are also coupled to a square/square root circuit 28. The variable gain "K" of the amplifier 24 will have a gain of unity under normal conditions but can have, typically, a range down to zero as will be explained hereinbelow.

In the circuit 28, the two uncorrected signals are separately squared, added together, and the square root of the sum is taken. Since the input signals are, under normal signal conditions, I cos $\phi$ and Q cos $\phi$, the output signal of the circuit 28 is the true envelope of the transmitted signal, 1+L+R.

The derivation of the true envelope signal can be better understood with respect to FIG. 2, a vector diagram. The vectors making up the larger triangle are (1+L+R), (L−R) and the square root of the sum of the squares of those two vectors. These three vectors represent the stereo signals of a non-compatible quadrature system, usually termed QUAM for quadrature amplitude modulation. The smaller triangle, with the same included angle $\phi$, represents C-QUAM, the compatible stereo signal of the above-referenced patent. It will be seen that each vector of C-QUAM equals the corresponding vector of QUAM multiplied by the cosine of the angle $\phi$. A received and detected signal can therefore be "corrected" by division by cosine $\phi$, for example. In formula form:

$$\begin{aligned}\text{envelope} &= \sqrt{(I\cos\phi)^2 + (Q\cos\phi)^2}\\ &= \sqrt{(1+L+R)^2\cos^2\phi + (L-R)^2\cos^2\phi}\\ &= \cos\phi\sqrt{(1+L+R)^2 + (L-R)^2}\\ &= \cos\phi\,[(1+L+R)/\cos\phi]\\ &= 1+L+R\end{aligned}$$

Returning now to FIG. 1, if the I signal tends to go negative frequently, a positive-hold circuit 29 may be inserted in the I cos $\phi$ path to the squaring circuit 28. An embodiment of the circuit 29 may be seen in FIG. 3 and will be explained with respect thereto.

When the true envelope signal is compared with the output signal of the divider 22, the difference is the required "correction signal". This correction signal is coupled back to the divider 22 and forces the divider output to be 1+L+R. The same correction signal is coupled to a second input of the divider 27 for correcting the Q signal and causing the divider output to be L−R. The output signals of the divider 22,27 are coupled to a matrix 34 which, in known fashion, provides outputs of L and R at output terminals 36,38.

Thus far the system has been discussed in the context of a suitable received signal. However, since there are, at least potentially, situations where the received stereophonic signal is far less than ideal, another function has been added to the receiver. The correction signal, cos $\phi$, from the comparator 30 is also coupled to a gain control circuit 40. The circuit 40 is coupled to control the voltage controlled amplifier 24 in the Q signal path. The amplifier could be an IC such as the Motorola MC 1495 or MC1595 multiplier (See the manufacturer's application notes). The gain control circuit 40 is a fast attack, slow decay circuit which responds to an input signal going beyond a predetermined reference voltage. The circuit 40 holds the value as a maximum, then allows the stored value to slowly decay until the actual value reaches the stored value. In more specific terms, when the value of the correction signal is determined to be out of the range normally expected (beyond 70% single channel modulation), the gain control circuit 40 begins to reduce the gain in the voltage controlled amplifier 24. This, naturally, reduces the level of the Q cos $\phi$ signal being coupled to the square/square root circuit 28. As the Q input to the circuit 28 is reduced, the circuit output approaches the value of I cos $\phi$ or (1+L+R) cos $\phi$. The output of the comparator 30 is reduced and the output of the divider 22 approaches (L+R) cos $\phi$. The signals at both of the matrix output terminals 36,38 approach (L+R) cos $\phi$, a slightly distorted QUAM signal.

In FIG. 3 may be seen an embodiment of the positive sample-and-hold circuit 29 which may be inserted between the delay 21 and the square/square root circuit 28. The purpose of this circuit is to prevent the value of the I signal going into circuit 28 from going negative. The sample-and-hold circuit includes a negative-going peak detector 44, a voltage-to-current converter 46 and a buffer circuit 48, all known in the art. The circuit 29 would probably be included only if the envelope signal used in the matrix 34 were taken from the square/square root circuit 28 output instead of from the divider 22 output.

Figure 4:
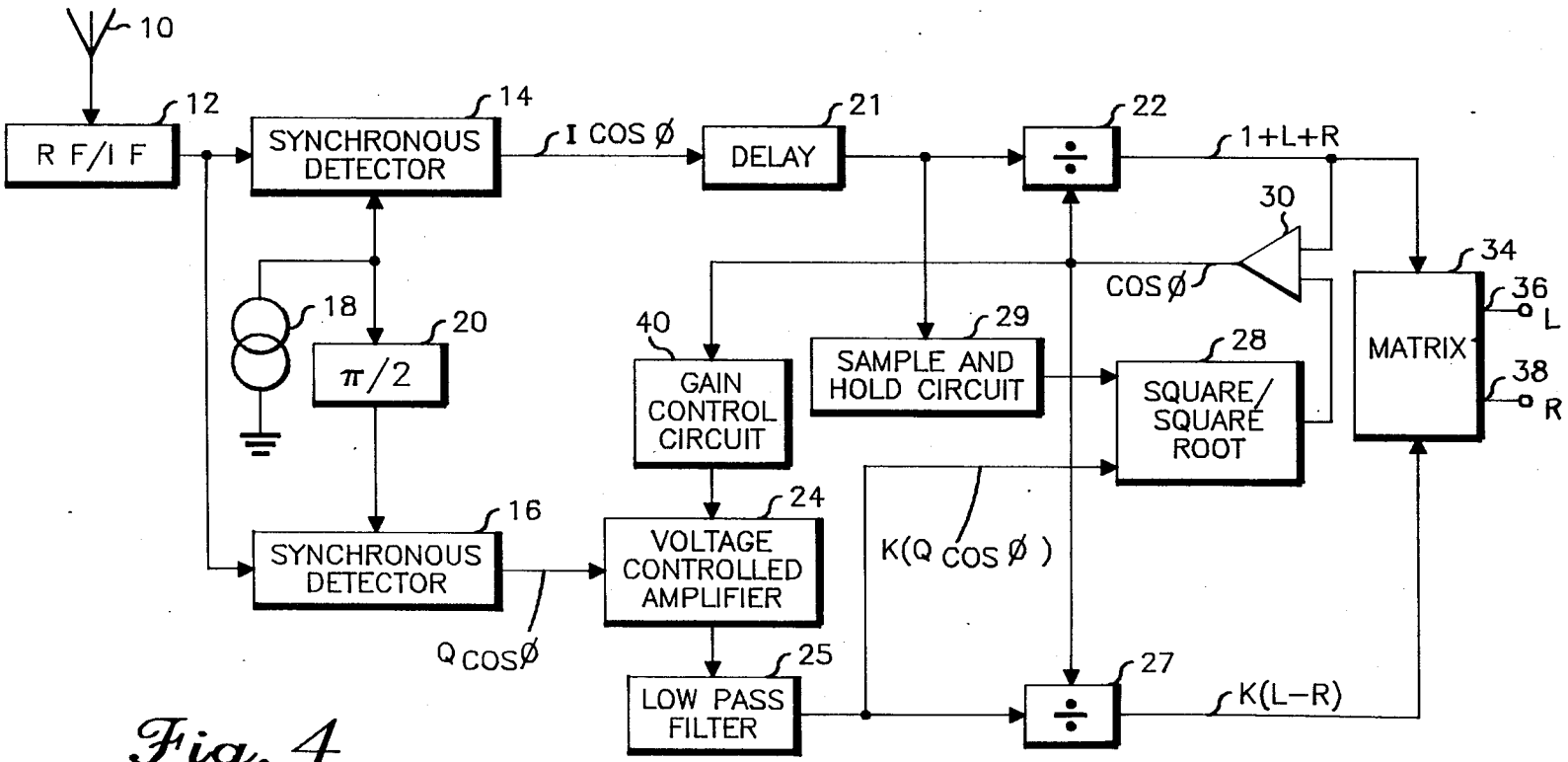
FIG. 4 is a block diagram of another embodiment of the receiver of FIG. 1.

In the block diagram of FIG. 4, another embodiment of the receiver of FIG. 1 is disclosed. In this modification, the Q cos $\phi$ signal from the synchronous detector 16 is coupled to the divider 27 by way of the voltage controlled amplifier 24 and filter 25. Thus, when a weak or noisy signal is being received, and the signal from the comparator 30 causes the gain control circuit 40 to attenuate the Q signal going to the square/square root circuit 28, the Q signal being corrected and coupled to the matrix 34 is also reduced. As in the receiver of FIG. 1, the output of the square/square root circuit approaches (1+L+R) cos $\phi$, which means that less correction appears in both I and Q. The output of the divider 27, then, is a Q signal attenuated by the voltage controlled amplifier 24 and having less correction than would normally be made. At the L and R outputs 36,38 of the matrix 34 the output signals begin to lose separation. For extremely poor reception conditions, however, it has been determined that optimum quality and minimum distortion are obtained by reducing both separation and correction, even if the output is, for brief periods, purely monophonic. In the limiting case, the circuit functions as if the detector 16, phase shifter 20, amplifier 24, and divider 27, were not present.

Thus, there has been shown and described a circuit for controlling the cosine correction function in an AM stereo receiver. As the received signal becomes less than satisfactory, the level of the correction signal is reduced. In a modification of the basic circuit, the stereo separation signal is also reduced, causing the stereophonic signal to move closer to the corresponding monophonic signal. The potential effects on the audio outputs caused by the unsatisfactory received signal are thereby reduced. Other variations and modifications are possible and it is intended to cover all such as fall within the spirit and scope of the appended claims.

I claim:

1. Correction control circuit for an AM stereophonic receiver and comprising:

input means for providing first and second input signals which were transmitted in quadrature with each other;

first and second corrector means coupled to correct each of the respective input signals;

a correction signal source coupled to derive a correction signal from at least said input signals and to provide said correction signal to said corrector means; and means for controlling the amount of second input signal coupled from the input means to the correction signal source in response to the correction signal level.

2. Correction control circuit for an AM stereophonic receiver in accordance with claim 1 and wherein said input means comprise a source of carrier frequency signal, phase shifting means for providing a second carrier frequency signal in quadrature with a first carrier frequency signal, and first and second detectors coupled to derive said input signals from the carrier signals.

3. Correction control circuit for an AM stereophonic receiver in accordance with claim 1 and wherein said controlling means comprises voltage controlled amplifier means for amplifying the second input signal and a control circuit coupled to receive the correction signal and to supply a control signal to said amplifier means in response to said correction signal.

4. Correction control circuit for an AM stereophonic receiver in accordance with claim 1 and wherein said correction signal source comprises means for deriving a true envelope signal from the input signals, and means for deriving the correction signal from the true envelope signal and the first input signal.

5. Correction control circuit for an AM stereophonic receiver in accordance with claim 1 and wherein said controlling means also controls the amount of second input signal coupled from the input means to the second corrector means in response to the correction signal level.

6. Correction control circuit for an AM stereophonic receiver in accordance with claim 1 and further including matrixing means for providing output signals in response to at least a signal derived from the first input signal.

7. Correction control circuit for an AM stereophonic receiver in accordance with claim 6 and wherein said matrixing means is coupled to receive signals derived from the first and second input signals.

8. A correction control circuit for an AM stereophonic receiver and comprising:

first and second input means for providing two input signals which were transmitted in quadrature:

first divider means coupled to the first input means for dividing a first one of said input signals by a correction signal;

controllable amplifier means coupled to the second input means for amplifying the second one of said input signals;

second divider means coupled to said amplifier means for dividing the amplifier output signal by a correction signal;

a correction signal source coupled to at least the first input means and the amplifier means for deriving said correction signal;

control means coupled to receive said correction signal for controlling said amplifier means; and output means coupled to the first and second divider means for matrixing the divider output signals.

9. A correction control circuit for an AM stereophonic receiver in accordance with claim 8 and wherein said amplifier means is a voltage-controlled amplifier, controllable within a range of about zero to approximately unity and said control means derives a control voltage from the correction signal.

10. A correction control circuit for an AM stereophonic receiver in accordance with claim 8 and wherein said correction signal source includes first circuit for deriving the true envelope signal from the two input signals when said input signals are satisfactory, and a second circuit for comparing said true envelope signal with the corrected first input signal.

11. A correction control circuit for an AM stereophonic receiver in accordance with claim 10 and wherein said output signal of the second circuit is normally cos $\phi$.

12. An AM stereophonic receiver for receiving compatible signals which require the use of a correction signal, and comprising:

receiving circuit means for selectively receiving and detecting AM signals;

first demodulator means coupled to said receiving circuit means for providing a first signal in response to the detected signal;

second demodulator means coupled to said receiving circuit means for providing a second signal in response to the detected signal, said second signal having been transmitted in quadrature to said first signal;

first and second corrector means coupled to the first and second demodulator means respectively for correcting the first and second signals;

correction signal source coupled to derive a correction signal from said first and second signals and to provide said correction signal to said first and second corrector means; and means for controlling the amount of signal coupled from the second demodulator means to the correction signal source in response to the correction signal level.

13. An AM stereophonic receiver according to claim 12 wherein the receiving circuit means includes means for providing an intermediate frequency output signal.

14. An AM stereophonic receiver according to claim 12 wherein said correction signal source includes means for deriving a true envelope signal from the first and second signals and means for deriving the correction signal from the true envelope signal and the first signal.

15. An AM stereophonic receiver according to claim 12 wherein the controlling means also controls the amount of signal coupled from the second demodulator means to the second corrector means in response to the correction signal.

* * * * *